US008953822B2

(12) United States Patent
Yan et al.

(10) Patent No.: US 8,953,822 B2
(45) Date of Patent: Feb. 10, 2015

(54) AUDIO VIBRATION EXCITER

(71) Applicants: Xu-Dong Yan, Shenzhen (CN); Yun Tang, Shenzhen (CN)

(72) Inventors: Xu-Dong Yan, Shenzhen (CN); Yun Tang, Shenzhen (CN)

(73) Assignees: AAC Acoustic Technologies (Shenzhen) Co., Ltd., Shenzhen (CN); AAC Technologies (Nanjing) Co., Ltd., Nanjing (CN)

( * ) Notice: Subject to any disclaimer, the term of this patent is extended or adjusted under 35 U.S.C. 154(b) by 29 days.

(21) Appl. No.: 14/022,283

(22) Filed: Sep. 10, 2013

(65) Prior Publication Data

US 2014/0072149 A1 Mar. 13, 2014

(30) Foreign Application Priority Data

Sep. 12, 2012 (CN) ..... 2012 2 0464606 U

(51) Int. Cl.

| | |
|---|---|
| ***H04R 25/00*** | (2006.01) |
| ***H04R 1/06*** | (2006.01) |
| ***H04R 7/04*** | (2006.01) |

(52) U.S. Cl.

CPC ..... *H04R 1/06* (2013.01); *H04R 7/045* (2013.01); *H04R 2400/03* (2013.01); *H04R 2440/05* (2013.01); *H04R 2440/07* (2013.01); *H04R 2499/11* (2013.01)

USPC ..... 381/162; 381/396; 381/412

(58) Field of Classification Search

USPC ..... 381/151, 152, 162, 326, 380, 396, 412, 381/417; 379/433.02; 455/567; 310/25

See application file for complete search history.

(56) References Cited

U.S. PATENT DOCUMENTS

| | | | | |
|---|---|---|---|---|
| 6,600,938 | B1 * | 7/2003 | Suzuki | 455/567 |
| 2006/0262954 | A1 * | 11/2006 | Lee et al. | 381/380 |
| 2012/0169146 | A1 * | 7/2012 | Choi | 310/15 |
| 2013/0119787 | A1 * | 5/2013 | Yu | 310/25 |

* cited by examiner

*Primary Examiner* — Tuan D Nguyen
(74) *Attorney, Agent, or Firm* — IPro, Inc.; Na Xu

(57) ABSTRACT

An audio resonance vibrator includes a yoke defining a bottom and a sidewall extending vertically from the bottom, an elastic frame cooperatively with the yoke forming a housing defining a receiving space, a magnet disposed on the bottom of the yoke cooperatively with the sidewall of yoke forming a magnetic gap, a vibrating unit accommodated in the receiving space defining a vibrating plate and a coil assembly connected with the vibrating plate. The coil assembly is at least partially received in the magnetic gap, and the vibrating plate is positioned on the elastic frame. The audio resonance vibrator further includes an elastic member interposed between the magnet and the vibrating plate to support the magnet.

8 Claims, 2 Drawing Sheets

AUDIO VIBRATION EXCITER

FIELD OF THE INVENTION

The present disclosure generally relates to the art of acoustic resonance devices, and more particularly to an audio vibration exciter provided with a resonant panel for generating sound.

DESCRIPTION OF RELATED ARTS

With the rapid development of the portable devices such as cellular phones and notebook computers, people request for more and more functions. All kinds of electronic devices constantly bring to people's lives in many convenience and fun. Among them, a lot of electronic devices are equipped with speaker body. Institutions can broadcast through a speaker sound signal, to play music, messages or oral communication and other activities.

Generally, a related speaker includes, for example, a exciter having a magnetic circuit part, a coil and a bobbin for holding the coil, and a light transmitting flat panel disposed over the entire face of the thin display device and doubling as a diaphragm that is vibrated by the exciter. When the coil is electrified by alternating current, the magnetic circuit part and the coil generates an alternating magnetic field. The flat panel is activated to move along a vibration direction for generating sound.

It has been found that the known panel-shaped speakers have only a poor acoustical performance, particularly in the upper part of the audio frequency range. Measurements have revealed that the average sound pressure at higher frequencies, i.e. of the order of 5 kHz and higher, is significantly lower than the average sound pressure at midrange frequencies, i.e. of the order of 350-5000 Hz. This is why to date the acoustical performance of panel-shaped speaker falls short of the acoustical performance of conventional speakers based on piston action and generally having conical diaphragms. However, as the vibration amplitude of the flat panel is weak which badly affects the low frequency sound quality, the life circuit of the speaker is short.

In the field of music enjoying of the notebook computers, a multifunction exciter enabling providing both audible and tactile sensations for amusement has already been widely used. The multifunction exciter is connected with a resonant panel which drives a vibrating member to vibrate to produce resonance with the resonant panel to produce a sound. Listening tests have revealed that the applied measure yields a substantial improvement of the reproduced sound. Also, such exciter has potential for beneficial resonance according to a second order characteristic effective to extend the low frequency response. Even if the vibrator is coupled with the resonant panel, the contacting relationship therebetween is not stable.

Therefore, considerations of vibration amplitude, resistance to impact shock etc. become important; and an improved exciter is provided in the present disclosure to solve the problems mentioned above.

DETAILED DESCRIPTION OF THE EXEMPLARY EMBODIMENT

Reference will now be made to describe the exemplary embodiment of the present disclosure in detail.

Figure 1:
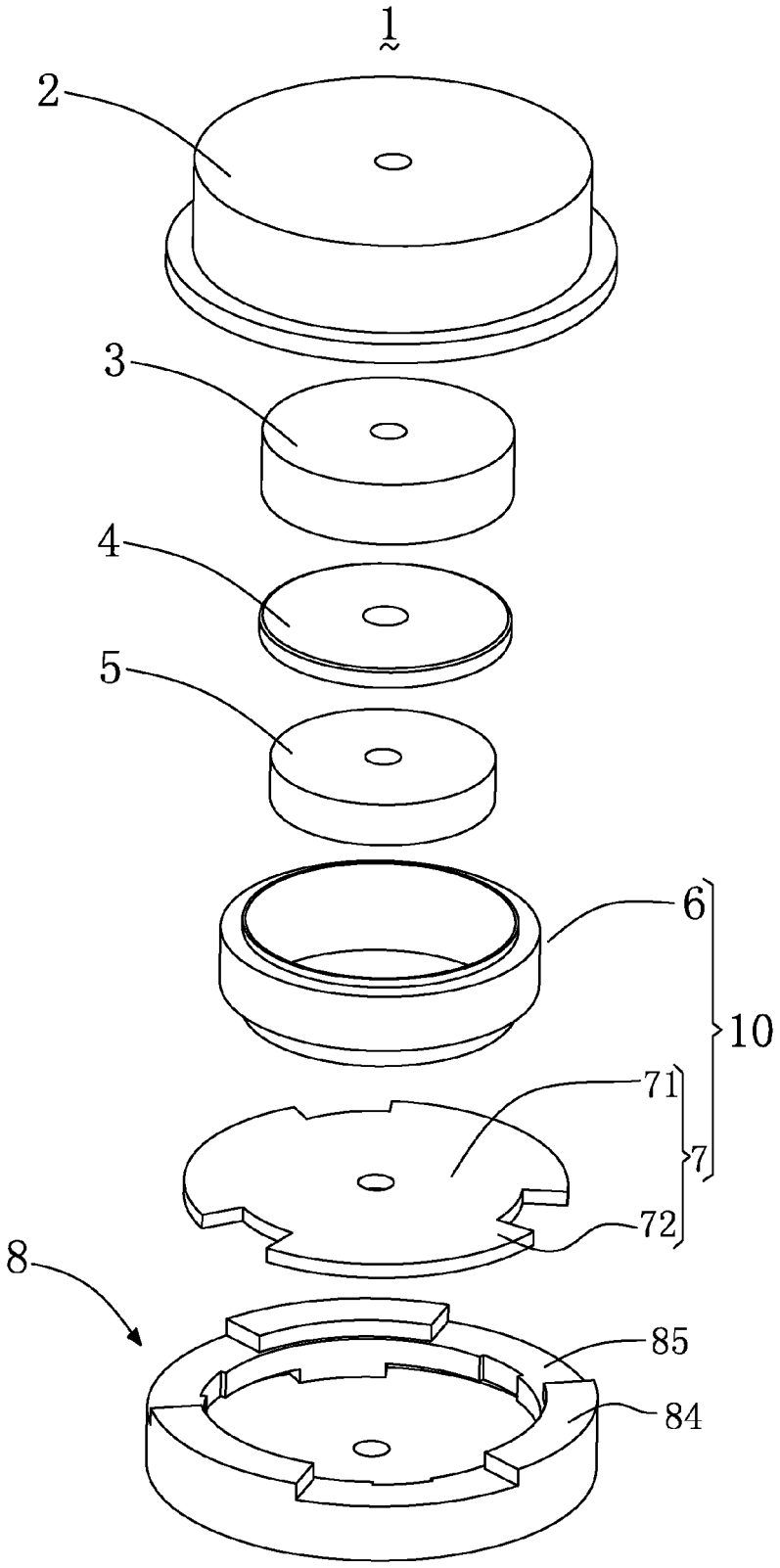
FIG. 1 is an isometric exploded view of an audio vibration exciter in accordance with an exemplary embodiment of the present disclosure.
Figure 2:
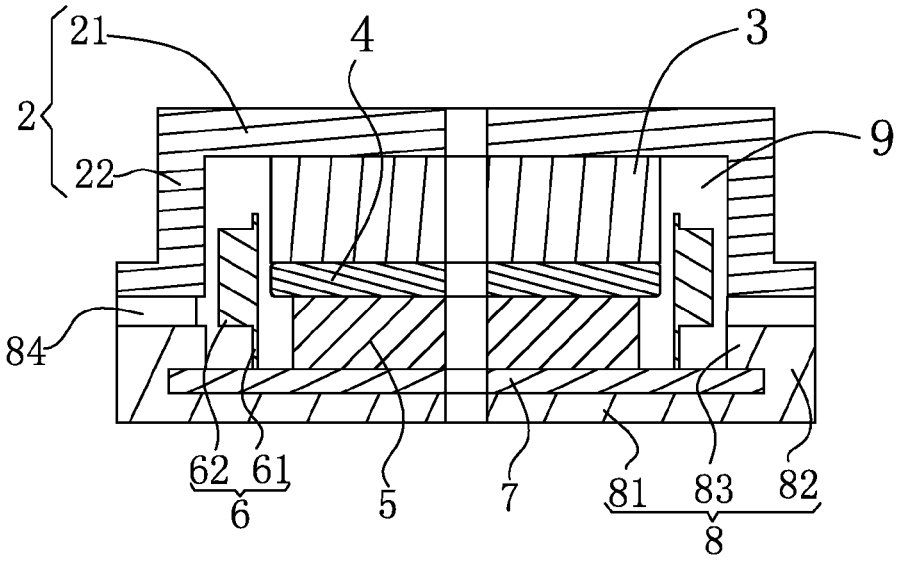
FIG. 2 is a cross-sectional view of the audio vibration exciter in FIG. 1.

Referring to FIGS. 1 through 2, the exemplary embodiment of the present invention discloses an audio vibration exciter 1. In general, the audio vibration exciter 1 is disposed on a resonant panel. The audio vibration exciter 1 is capable of driving the resonant panel to vibrate in a proper frequency range so as to generate sound. For enhancing the low frequency sound quality, the resonant panel is made from rigid material, such as a metal plate, glass, or wood. It is also can be made from semi-rigid cardboard, plastic plate. In the present embodiment, the resonant panel may be a part of an outer case of a notebook computer or a part of a table. And other feasible panel.

The audio vibration exciter 1 has an elastic frame 8 disposed on a resonant medium, a yoke 2 supported by the elastic frame 8 corporately forming a housing having a receiving space 9. The receiving space 9 of the housing accommodates a magnet 3, a pole plate 4 mounted on the magnet 3, an elastic member 5 and a vibrating unit 10 therein. The yoke 2 has a bottom 21 and a sidewall 22 extending vertically from the bottom 21. The yoke 2 is configured to be like a bowl and has a hollow space for accommodating the magnet 3 and pole plate 4. The magnet 3 is positioned on a central part of the bottom 21 of the yoke 2. The pole plate 4 is mounted on the magnet 3. A magnetic gap is formed by an outer surface of the magnet 3 and an inner surface of the yoke 2. The vibrating unit 10 includes a vibrating plate 7 embedded in the elastic frame 8 and a coil assembly 6 connected directly or indirectly with the vibrating plate 8. In the embodiment, the vibrating plate 7 means a printed circuit board for electrical connecting the coil assembly 6 to external circuit. The coil assembly 6 further includes a coil 62 and a bobbin 61 wrapped by the coil 62. The coil 62 is at least partially received in the magnetic gap and the bobbin 61 is positioned on the printed circuit board. When electrified, the coil assembly 6 vibrates along a direction upright to the vibrating plate 7 so as to force the vibrating plate 7 to vibrate.

Furthermore, the elastic frame 8 is a first damper configured for restricting steady-state vibration amplitude at resonance. It is optional that the elastic frame may be made from elastic foam or rubber, such as silica gel. The elastic frame 8 has a bottom wall 81, a sidewall 82 extending vertically from the bottom wall 81 and a supporting portion 83 extending perpendicularly from the sidewall 82 along a direction parallel to the bottom wall 81. The sidewall 22 of the yoke 2 may be supported by the supporting portion 83. Consequently, in the present embodiment, a slot is formed between the bottom wall 81 and the supporting portion 83 for receiving the vibrating plate 7. In addition, the elastic frame 8 further includes a plurality of projections 84 extending from the supporting portion 83 for supporting the yoke 2. Consequently, a notch 85 is formed between two adjacent projections 84 for balancing the air pressure of the receiving space 9 of the housing.

In the exemplary embodiment, for fixing the vibrating plate 7 in proper position firmly, the printed circuit board as one vibrating member includes a body 71 and a plurality of branches 72 extending from the body along a direction parallel to the body 71 for accommodating the slot. In other words, the edge of the branches 72 is at least partially sandwiched between the bottom wall 81 of the elastic frame 8 and the supporting portion 83. Thereby, the vibrating plate 7 is assembled with the bottom wall 81 of the elastic frame 8 by injection molding or other assembling method.

Optionally, the elastic member 5 is a second damper configured for enhancing or restraining steady-state vibration amplitude at resonance. The second damper is located between the pole plate 4 and the vibrating plate 7, with two ends thereof connecting with the pole plate 4 and the vibrating plate 7, respectively. In other words, the elastic member 5 is interposed between the pole plate 4 and the vibrating plate 7 to support the pole plate 4. Alternatively, the pole plate is not a necessary components, the elastic member 5 is also not directly fixed to the pole plate. Accordingly, the elastic member 5 is sandwiched between the magnet 2 and the vibrating plate 7.

An elastic material molded body formed by molding an elastic material selected from a thermoplastic elastomer, a vulcanized rubber and a soft resin into a block shape, a sheet shape or a plate shape may be employed as the elastic member 5. An elastic foam material body formed by foaming one of the above elastic materials into a block shape, a sheet shape or a plate shape may also be employed as the elastic member 5. The coefficient of elasticity and the volume of the elastic member 5 are determined according the force to act on the magnet 3.

When contacting the resonant medium, the audio vibration exciter 1 provides a high-frequency vibration signal to the resonant medium by virtue of the vibration of the vibrating plate 7 thereof, the vibration signal will cause the resonant medium together with the vibrating plate 7 to synchronous vibrate in a frequency range so as to generate sound. Especially, the audio vibration exciter 1 can generate high quality low frequency sound by virtue of the bottom wall 81 of the elastic frame 8 serving as a damping plate.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. An audio vibration exciter, comprising:

an yoke defining a bottom and a sidewall;

an elastic frame cooperatively with the yoke forming a housing defining a receiving space;

a magnet disposed on the bottom of the yoke cooperatively with the sidewall of yoke forming a magnetic gap;

a vibrating unit accommodated in the receiving space defining a vibrating plate and a coil assembly connected with the vibrating plate, the coil assembly at least partially received in the magnetic gap, the vibrating plate positioned on elastic frame; wherein an elastic member is interposed between the magnet and the vibrating plate to support the magnet.

2. The audio vibration exciter as described in claim 1, wherein a pole plate is mounted on the magnet, the elastic member is located between the pole plate and the vibrating plate, with two ends thereof connecting with the pole plate and the vibrating plate.

3. The audio vibration exciter as described in claim 2, wherein the elastic frame defines a bottom wall, a side wall extending vertically from the bottom, and a supporting portion extending inwardly from the sidewall along a direction parallel to the bottom wall of the elastic frame.

4. The audio vibration exciter as described in claim 3, wherein the elastic frame further defines a plurality of projections extending from the supporting portion for supporting the yoke.

5. The audio vibration exciter as described in claim 3, wherein the vibrating plate defines a body and a plurality of branches extending from the body along a direction parallel to the body, the edge of the branches at least partially sandwiched between the bottom wall of the elastic frame and the supporting portion of the elastic frame.

6. The audio vibration exciter as described in claim 5, wherein the coil assembly includes a coil and a bobbin wrapped by the coil.

7. The audio vibration exciter as described in claim 5, wherein the vibrating plate serves as a printed circuit board.

8. An audio vibration system, comprising:

a resonant medium;

an audio vibration exciter as described in claim 1, disposed on the resonant medium for driving the resonant medium to vibrate so as to generate sound.

* * * * *